US006945523B2

(12) United States Patent
Degen

(10) Patent No.: US 6,945,523 B2
(45) Date of Patent: Sep. 20, 2005

(54) CLAMPING TOOL COMPRISING A DISPLACEABLE AND REPOSITIONABLE FIXED CLAMPING JAW

(75) Inventor: Klemens Degen, Weibern (DE)

(73) Assignee: wolfcraft GmbH, Kempenich (DE)

( * ) Notice: Subject to any disclaimer, the term of this patent is extended or adjusted under 35 U.S.C. 154(b) by 95 days.

(21) Appl. No.: 10/380,152

(22) PCT Filed: Aug. 31, 2001

(86) PCT No.: PCT/EP01/10071

§ 371 (c)(1),
(2), (4) Date: Aug. 7, 2003

(87) PCT Pub. No.: WO02/22312

PCT Pub. Date: Mar. 21, 2002

(65) Prior Publication Data

US 2004/0046300 A1 Mar. 11, 2004

(30) Foreign Application Priority Data

Sep. 12, 2000 (DE) ..... 100 45 053
Jul. 2, 2001 (DE) ..... 101 31 966

(51) Int. Cl.[7] ..... B25B 1/00
(52) U.S. Cl. ..... 269/90; 269/296
(58) Field of Search ..... 269/90, 140, 296, 269/297, 300, 301

(56) References Cited

U.S. PATENT DOCUMENTS 1,504,931 A * 8/1924 Blasezyk ..... 29/89.5
3,974,868 A 8/1976 Derbyshire
4,415,149 A * 11/1983 Rees ..... 269/88
4,858,902 A 8/1989 Hickman
4,989,847 A 2/1991 Chapman
5,005,449 A 4/1991 Sorensen et al.
5,150,887 A * 9/1992 Weissenborn et al. ..... 269/71
5,885,036 A 3/1999 Wheeler
6,578,837 B1 6/2003 Blank et al.

FOREIGN PATENT DOCUMENTS

DE 33 47 232 A1 7/1985
DE 44 43 333 A1 7/1995
DE 197 31 579 A1 1/1999
FR 2 785 213 A1 5/2000

* cited by examiner

*Primary Examiner*—Jacob K. Ackun, Jr.
(74) *Attorney, Agent, or Firm*—Everest Intellectual Property Law Group

(57) ABSTRACT

The invention relates to a clamping tool com-prising a clamping jaw (5), which is releasably fixed on a rail, preferably at the end (2) thereof, and which comprises a pin (4) that passes through an opening of the rail. The clamping jaw is releasably fixed on the rail, whereby, after pulling the pin (4) out of the opening, the clamping jaw can be fixed at an opening (3) located at another position of the rail, preferably at its other end by reinserting the pin into an opening (3) located at that po-sition. A second clamping jaw (7) is displaceably arranged on said rail (1). A tightening element (8) is used to bring the second clamping jaw, according to the location of the first clamping jaw (5) on the rail (1), into a clamping position in the direction of the latter or in a direction away from the latter. The aim of the invention is to achieve a simplified changing from one fixing position to another fixing position on the rail. To this end, the pin (4) is assigned in a captive manner to the first clamping jaw (5) and is held i the engaged position inside the opening by the force exerted by a spring (9) that is tensioned when the bolt is pulled out of the opening (3).

11 Claims, 7 Drawing Sheets

CLAMPING TOOL COMPRISING A DISPLACEABLE AND REPOSITIONABLE FIXED CLAMPING JAW

Figure 1:
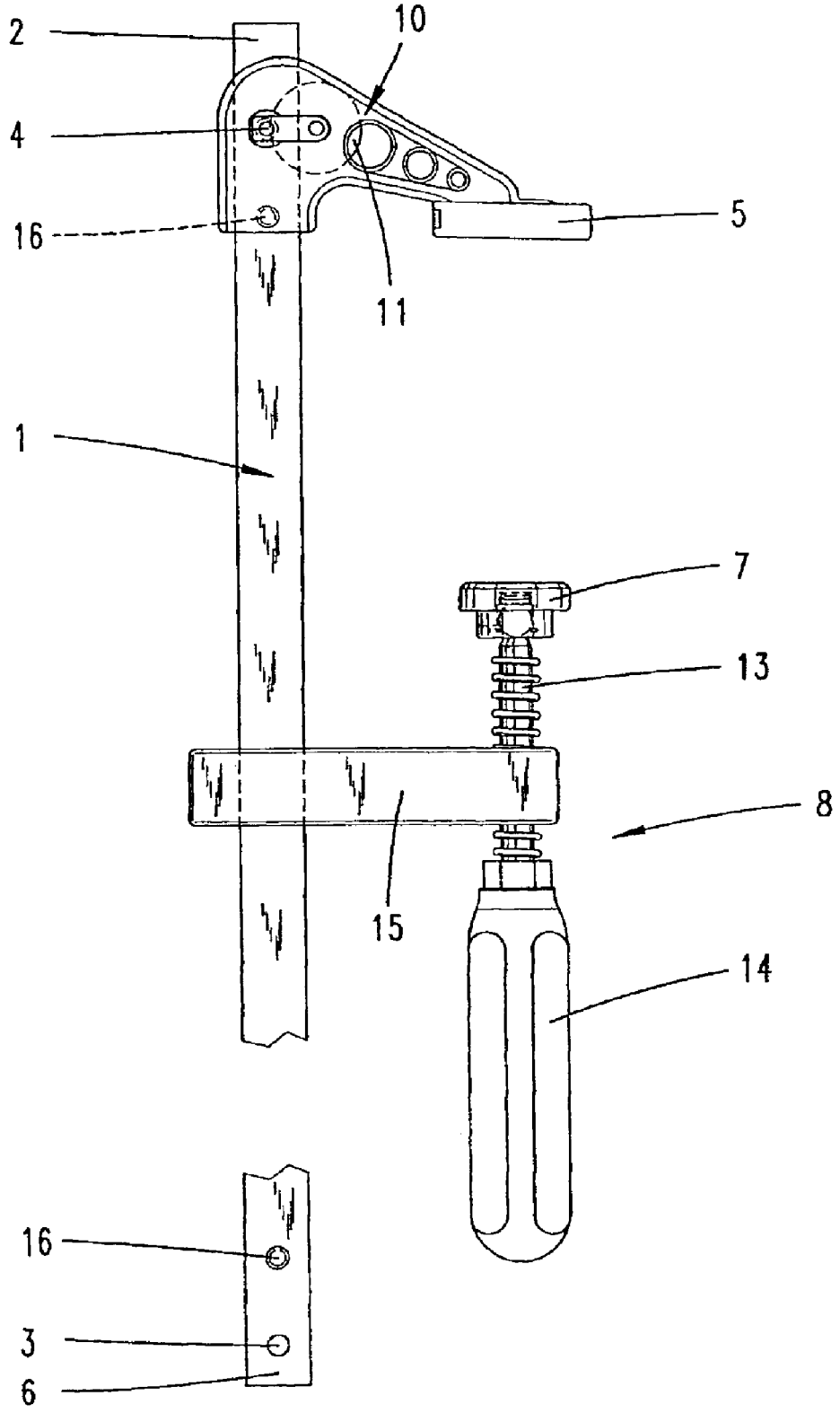

The invention relates to a clamping tool comprising a clamping jaw which is mounted in a releasable manner on a rail, preferably at the end of the latter, by a bolt, which passes through an opening of the rail, such that, once the bolt has been drawn out of the opening, it can be mounted at another location of the rail, preferably at the other end of the latter, by virtue of the bolt being inserted into an opening there, on which rail there is disposed in a displaceable manner a second clamping jaw which, depending on the arrangement of the first clamping jaw on the rail, can be moved, by means of a clamping device, into a clamping position in the direction of the first clamping jaw or in the direction away from the same.

Such a clamping tool in the form of a screw clamp is known from DE 33 47 232 A1. In this document, the clamping jaw which is firmly connected to the rail is associated with a clamping-jaw carrier which projects at right angles from the rail. This clamping-jaw carrier has a slot. The end of the rail is inserted into this slot and secured by a bolt, a thumb nut being screwed onto the thread of this bolt. An opening is likewise located at the other end of the rail. The displaceable clamping jaw is likewise seated on a clamping-jaw carrier. The clamping-jaw carrier can be displaced with sliding action on the rail and can remain there in a tilted position. This tilted position is achieved if the clamping jaw which is seated at the end of a screw spindle is moved into a clamping position in relation to the other, fixed clamping jaw. For this purpose, the grip seated at the other end of the spindle is rotated. If the fixed clamping jaw is mounted on the rail such that the displaceable clamping jaw is moved toward the fixed clamping jaw by virtue of the clamping device being actuated, then it is possible for a workpiece to be clamped in between the two clamping jaws. If, in contrast, the fixed clamping jaw is fitted on the other side of the rail, so that the clamping device displaces the displaceable clamping jaw away from the fixed clamping jaw, then the clamping tool acts as an expanding tool.

Such a clamping tool is also already known from DE 197 31 579 A1. In this document, the clamping device has a step-by-step mechanism by means of which the entire displaceable clamping-jaw carrier can be moved along the rail in steps by virtue of a handle being actuated, the displaceable clamping jaw being moved away from the fixed clamping jaw or toward the same, depending on the arrangement of the fixed clamping jaw. Provision is also made here, by virtue of a bolt which passes through an opening of the rail being released, for the clamping-jaw carrier which carries the fixed jaw to be positioned on one side of the rail or the other, in order to be mounted there, so that the clamping tool is capable either of clamping in a workpiece between the two clamping jaws or of being positioned with spreading action in an opening of a workpiece. The clamping tool described here is additionally provided with a release lever which can release the two clamping jaws out of the clamping position. This release lever engages in the step-by-step mechanism such that, by virtue of the lever being actuated, it is also possible for the entire clamping device to be displaced back.

It is an object of the invention to simplify the operation of changing the fixed clamping jaw from one mounting location on the rail to the other.

The object is achieved by the invention given in the claims. claim 1 provides, in particular, that the bolt is associated in captive fashion with the first clamping jaw. It thus cannot be lost once it has been drawn out of the opening of the rail. The bolt, furthermore, is retained in the engagement position in the opening by the force of a spring which is subjected to stressing when the bolt is displaced out of the opening. Accordingly, in order to release the fixed clamping jaw from the rail, all that is necessary is for the bolt to be displaced counter to the force of the spring. There is no longer any need for a thumb screw to be loosened, as is the case in the prior art. The use of a spring which forces the bolt into the engagement position has the additional advantage that the positive fit between clamping-jaw carrier and rail does not have to be deliberately produced. The bolt enters automatically into the opening whenever the jaw is pushed over the rail and the end side of the bolt is aligned with the opening. As a result of an advantageous development, a push button is coupled to the bolt such that, by virtue of pressure being applied to it, the bolt is displaced. The coupling here is provided such that the pressure applied to the push button displaces the bolt out of the opening. As long as the push button is retained in the pressed-in position, the bolt is in the withdrawn position. If the push button is released, then the bolt can enter into the opening if the latter is in alignment with the bolt. In order to form this advantageous function, it is particularly advantageous if the bolt is associated with a U-shaped catch member. It is preferably formed by a short leg of this catch member. The longer leg of the U-shaped catch member projects through the clamping-jaw carrier such that it is secured on the underside of the push button, so that a displacement movement of the longer U-leg is transmitted, via the U-web, to the short bolt, so that the latter is drawn out of the opening. The spring, which retains the short leg of the U-shaped catch element in the engagement position, is preferably seated in the vicinity of the push button. It may be located centrally beneath the push button, so that the resilient mounting for the push button is simultaneously the resilient mounting for the bolt. The bolt here preferably projects through the center of a through-opening for the rail. The length of the U-web here is selected such that the long U-leg passes through the jaw carrier outside the rail. In the locking position, the free end of the bolt may be located in an opening of the inner through-opening wall, this avoiding bending of the bolt as a result of the advantageous introduction of force during clamping. In order to achieve an arrangement of the push button which is advantageous in terms of actuation, the longer U-leg is seated eccentrically, rather than centrally, on the push button. As a result, for all practical purposes, the push button is located in an overlapping position with the rail. It is also possible for a penetrating extension to be disposed on the rear side of the push button, on which the spring and the longer U-leg is seated. The spring may be seated between this penetrating extension and the longer U-leg. With the push button retained in the pushed-in position, the extension is located in a broad-side recess of the first jaw, which is located beneath the push button. The push button may be provided as an exposed part. Provision is also made, however, for the push button to be located in a cup-like opening of the broad side of the clamping-jaw carrier. This prevents undesired actuation of the push button. The cup-like opening may be enclosed by the wall of a sleeve. In the locking position, the end border of this sleeve is aligned with the surface of the push button. The web, which is located opposite the push button and connects the push rod to the bolt, is likewise located in a housing recess. Provision is also made here for the end border of the wall of this housing recess to be aligned with the surface of the web.

Figure 2:
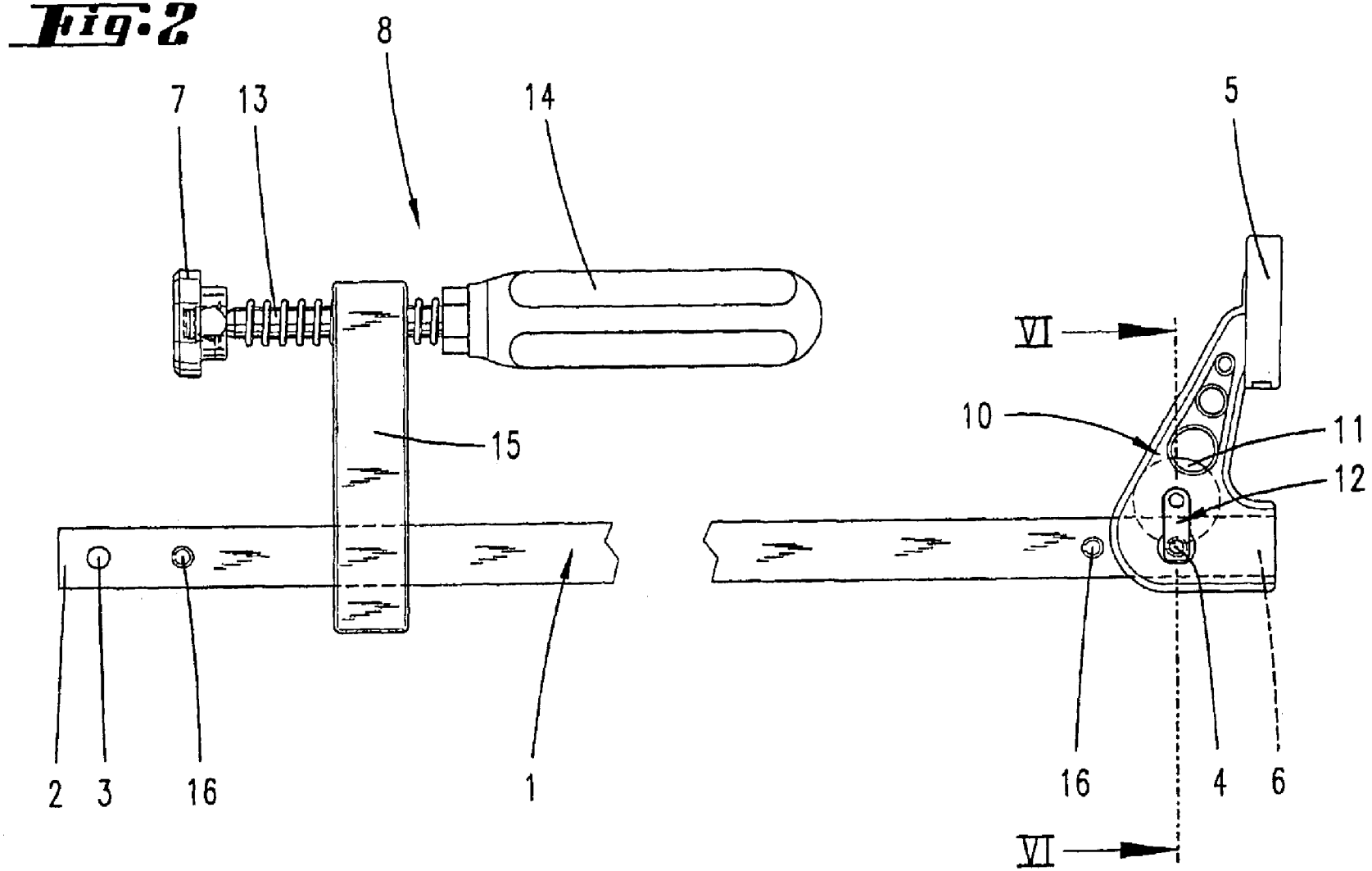
Figure 4:
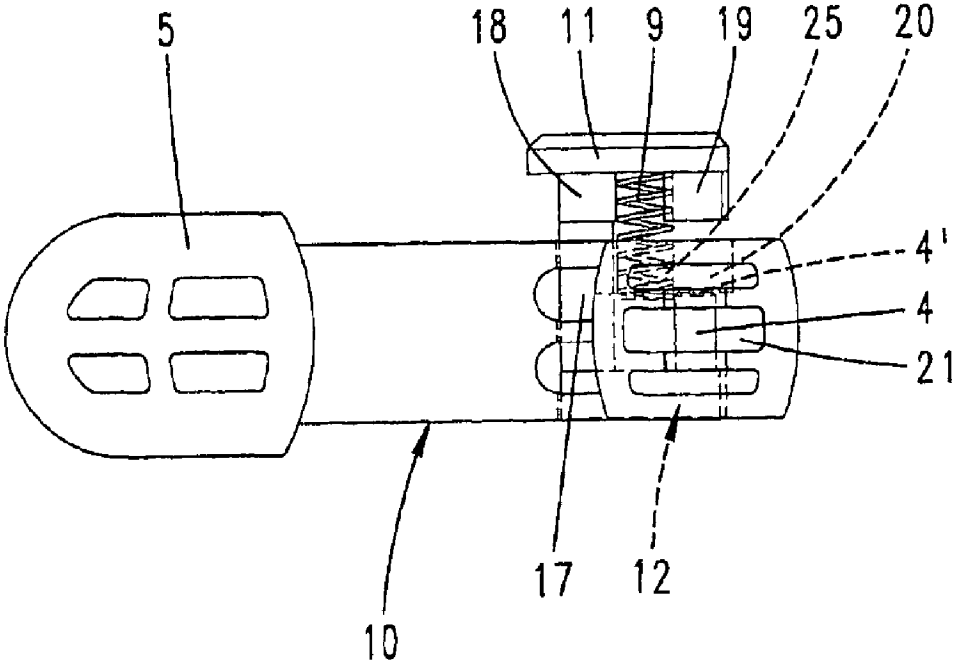
Figure 3:
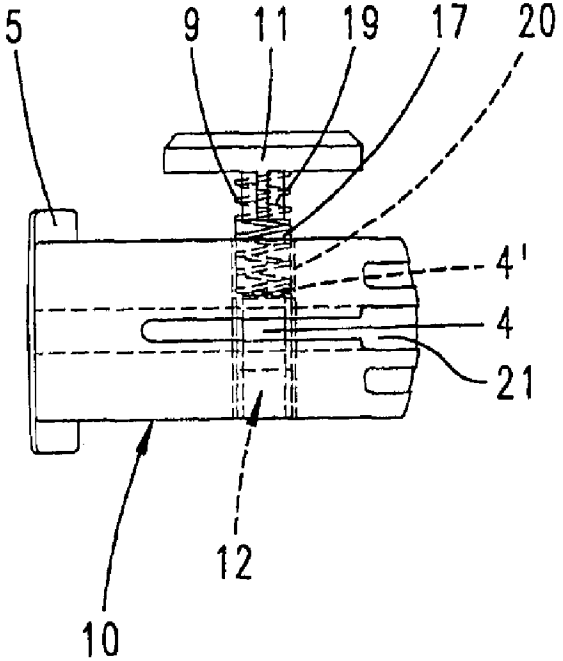
Figure 6:
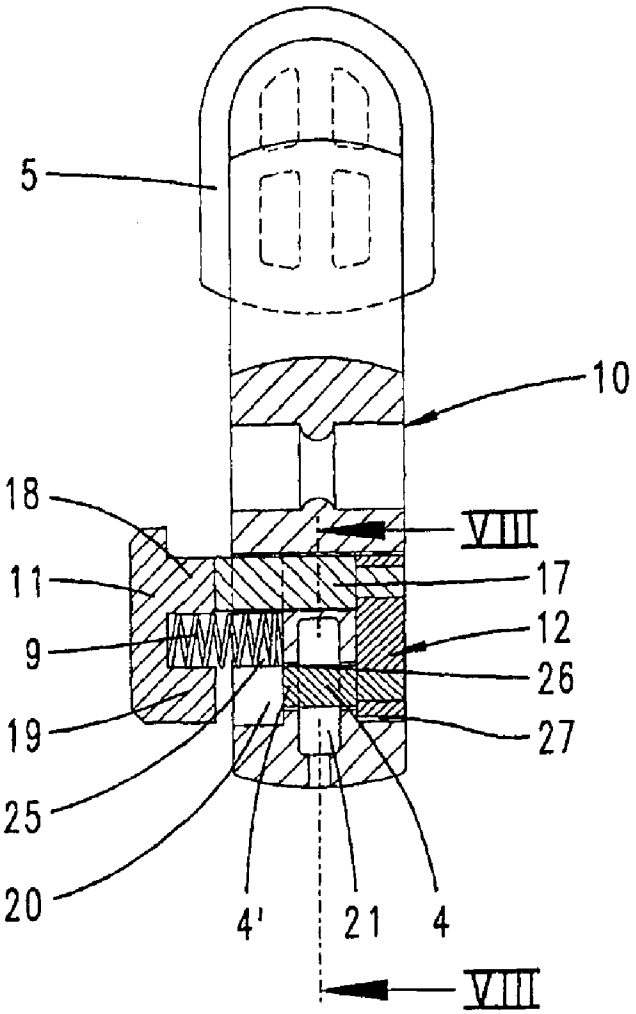
Figure 5:
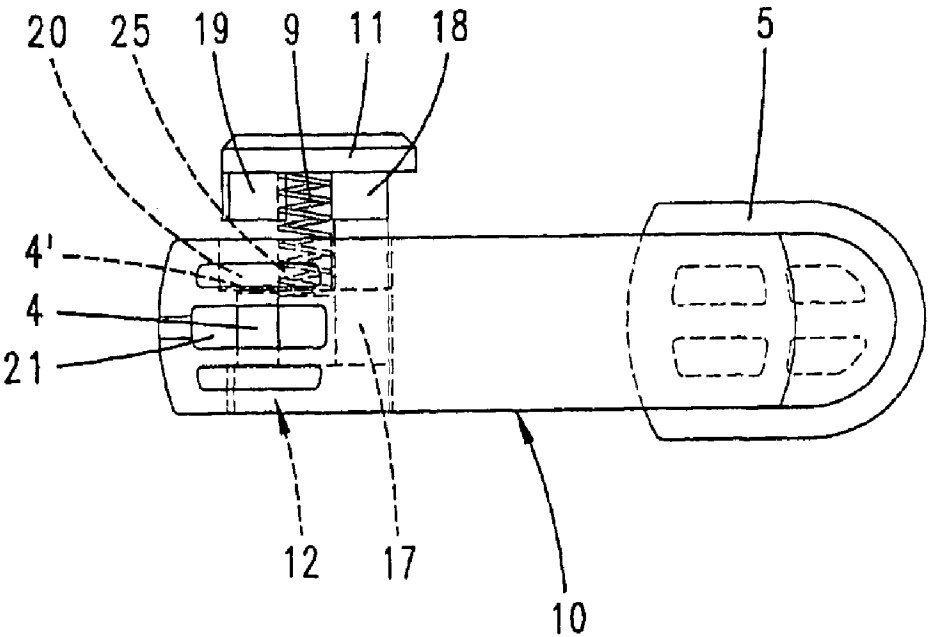
Figure 8:
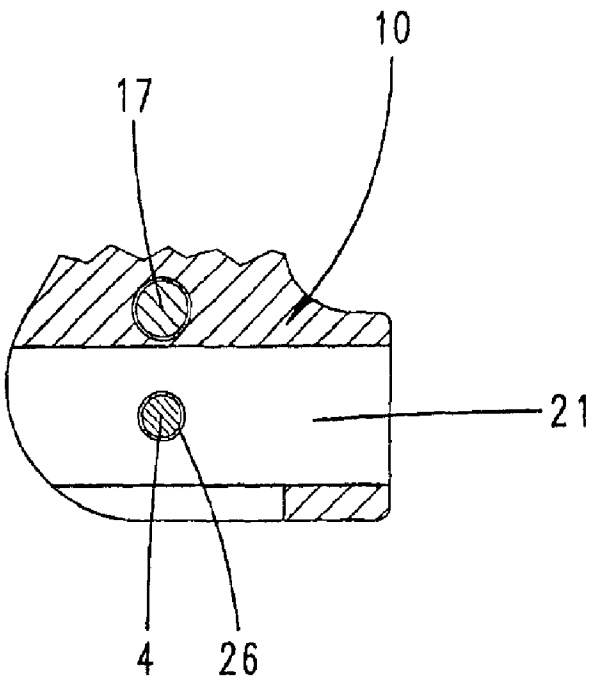
Figure 7:
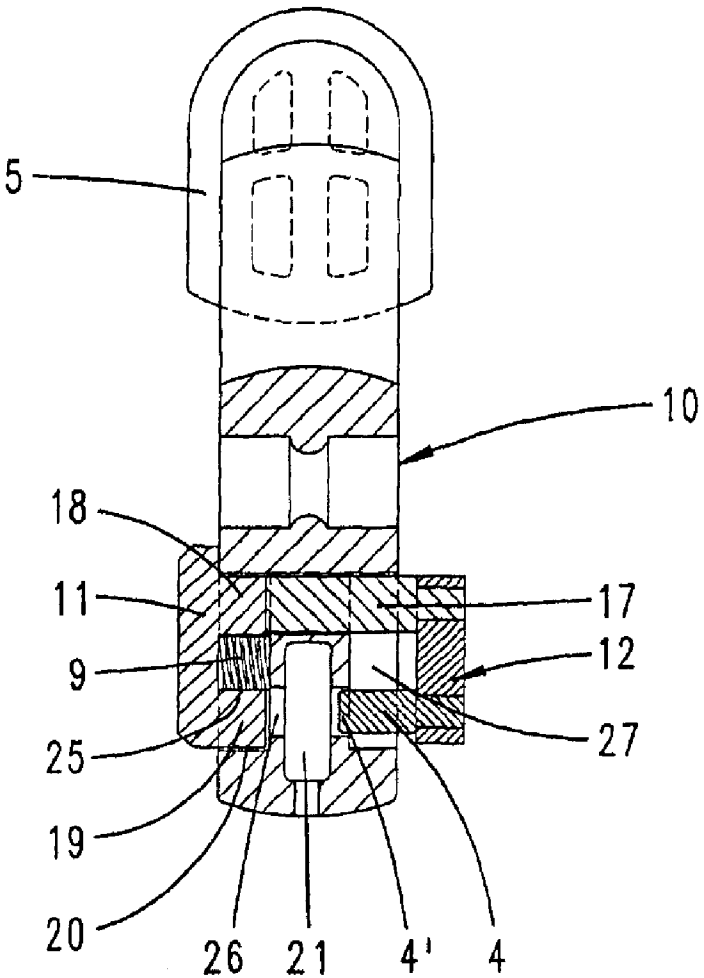
Figure 6:
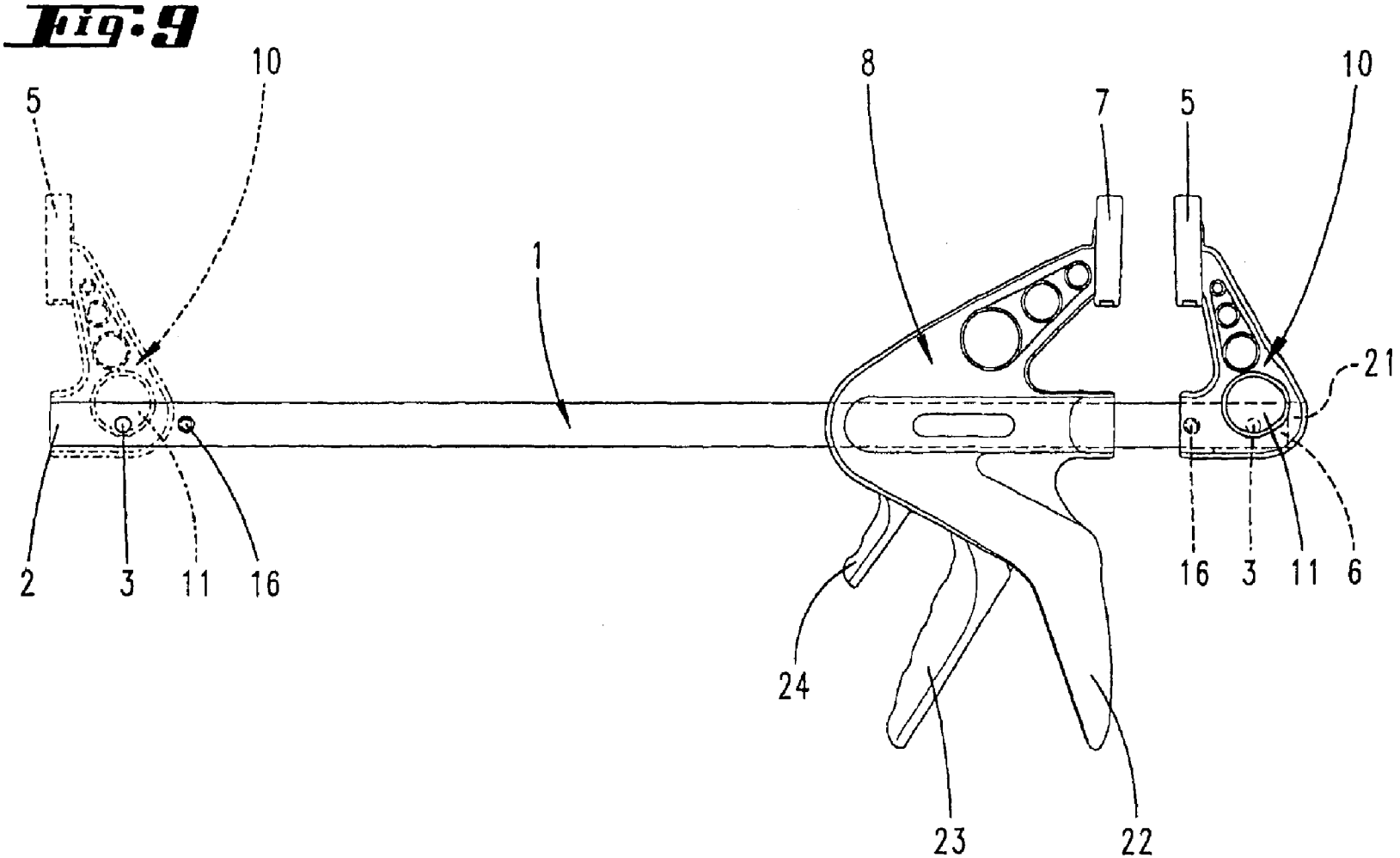
Figure 10:
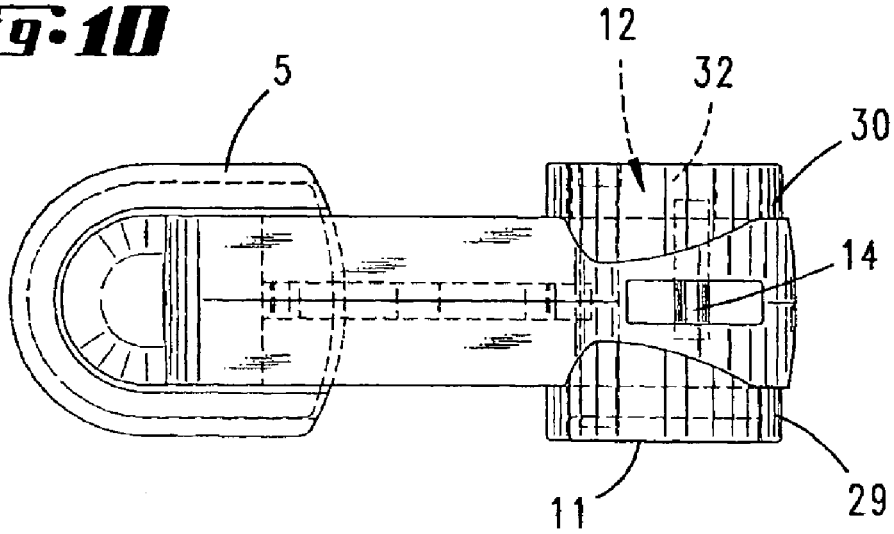
Figure 11:
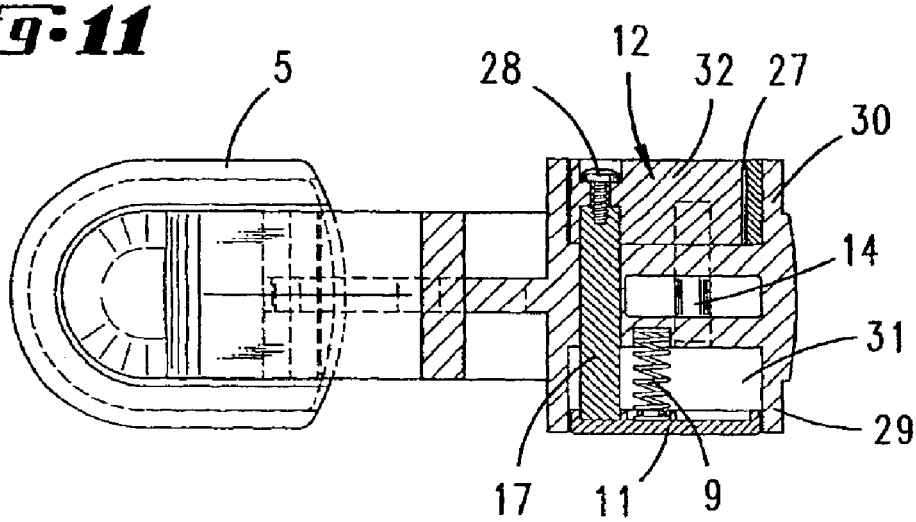
Figure 13:
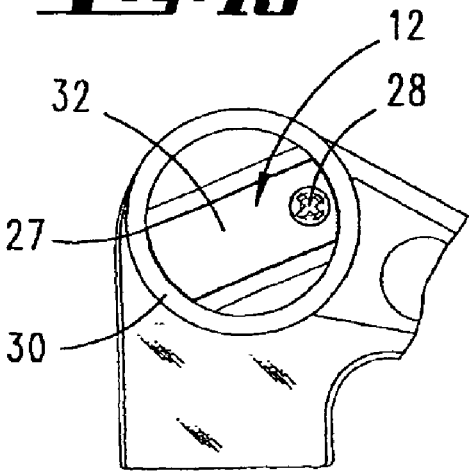
Figure 12:
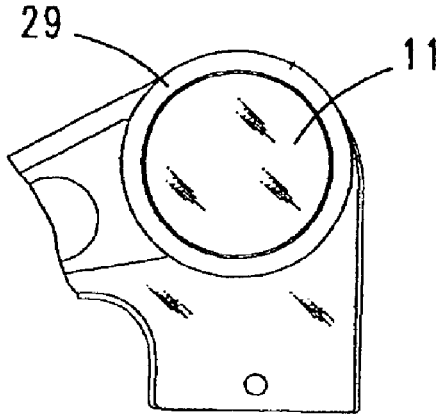

Exemplary embodiments of the invention are explained hereinbelow with reference to attached drawings, in which:

FIG. 1 shows a first exemplary embodiment of the invention, in the case of which the clamping tool is a screw clamp, FIG. 2 shows the exemplary embodiment according to FIG. 1 with the fixed clamping jaw turned round, FIG. 3 shows a side view of the fixed clamping jaw, FIG. 4 shows a front view of the fixed clamping jaw, FIG. 5 shows a rear view of the fixed clamping jaw, FIG. 6 shows a section along line VI—VI in FIG. 2, FIG. 7 shows an illustration according to FIG. 6 with the push button pressed in, FIG. 8 shows a section along line VIII—VIII in FIG. 6, FIG. 9 shows a second exemplary embodiment of the invention, in the case of which the clamping tool is formed as a one-hand clamp clip with a rearward displacement function, FIG. 10 shows a further exemplary embodiment of a displaceable clamping jaw, in side view, FIG. 11 shows a sectional illustration, similar to FIG. 6, of the exemplary embodiment illustrated in FIG. 10, FIG. 12 shows a plan view of the push button, and FIG. 13 shows a bottom view of the web.

The clamping tool according to the invention has a rail 1 onto which a displaceable clamping jaw 7 can be displaced. A fixed clamping jaw 5 is disposed opposite the displaceable clamping jaw 7. The fixed clamping jaw 5 is firmly connected to one end 2 of the rail. For connecting purposes, use is made of a bolt 4 which engages through an opening 3 of the rail 1. By virtue of the bolt 4 being drawn out, the clamping-jaw carrier 10, which carries the clamping jaw 5, can be removed from the end 2 of the rail and inserted onto the other end 6 of the rail 1 such that the displaceable clamping jaw 7 is oriented away from the fixed clamping jaw 7.

The displaceable clamping jaw 7 is also mounted on the slide rail 1 by means of a clamping-jaw carrier 15. For this purpose, the clamping-jaw carrier 15 defines, in a known manner (cf. DE 33 47 232), a sleeve through which the rail 1 is inserted. If the clamping-jaw carrier 15 is subjected to a torque in the clamping direction, the sleeve 15 tilts on the rail 1. The clamping-jaw carrier 15 is then fixed in position. The clamping-jaw carrier 15 has a threaded bore at its free end. A spindle 13 is inserted through this threaded bore. The displaceable clamping jaw is located at one end of the spindle 13, and a handgrip 14 is located at the other end of the spindle 13. If the handgrip 14 is rotated, then the displaceable clamping jaw 7 is displaced either into the expanding position or into the clamping position. The spindle 13 and clamping-jaw carrier 15 are elements of the clamping device 8.

The exemplary embodiment illustrated in FIG. 9 uses the same fixed clamping jaw 5, in design terms, as the first exemplary embodiment, which the FIGS. 1 and 2 shows. Here too, the clamping-jaw carrier which carries the fixed clamping jaw 5 is provided with a through-opening 21 into which the rail 1 can project, so that a bolt 4 which passes through the through-opening 21 can project through the opening 3 of the rail 1, so that the clamping-jaw carrier 10 can be fixed either at the end 2 or at the end 6 of the rail.

The clamping device 8 here is in the form of a mechanism housing. It carries the displaceable clamping jaw 7 on one side and three grips on the other side. One grip 22 is a handgrip. A grip which is located adjacent to the handgrip 22 is a handle 23. If pressure is applied to this handle, then the displaceable clamping jaw 7 moves in the direction of the end 3 of the rail. As a result of the mechanism described in DE 197 31 579, the handle-actuated displacement takes place in a manner which is blocked against return. The return block may be eliminated by virtue of the release lever 24 being actuated. As a result of the particular mechanism configuration (DE 197 31 579), a further actuation of the release lever 24 causes the entire clamping device 8 to be displaced in a rearward direction.

Whereas the rail is preferably produced from metal, the clamping-jaw carrier 10 is formed as an injection molding. The clamping jaw 5 may be formed by a soft plastics coating. The through-opening 21 has a stop cutout for a rail-mounted stop 16, which is positioned such that, in the stop position, the bolt 4 is aligned with the opening 3 of the rail.

In the engagement position in the through-opening 21, the bolt 4 passes through the latter approximately centrally. The free end 4' of the bolt 4 here enters into a broad-side opening 26 of the through-opening 21. The bolt 4 is the shorter U-leg of a U-shaped catch member 12. The latter is made up of a plurality of constituent parts. The U-web of the multi-part catch member 12, in the engagement position, is positioned in a slot recess of the broad side of the jaw carrier, so that it does not project out of the broad side of the jaw carrier. The longer U-leg of the catch member 12 projects through the entire width of the jaw carrier 10 and is seated firmly, by way of its free end, on an eccentric extension 18 of a push button 11, which is located on the other broad side of the clamping-jaw carrier 10. Located on the rear side of the push button 11, approximately in the center of the latter, is a compression spring 9, which is also subjected to stressing in the engagement position. The compression spring 9 is supported on the rear side of the push button and on the base of a spring-accommodating chamber 25. Also disposed on the rear side of the push button is a penetrating extension 19, which is located opposite the extension 18 and, when the push button is pressed in, penetrates into a depression 20.

If the push button 11 is actuated, then the spring 9 is compressed further. It may be located in its entirety in the spring-accommodating chamber, so that the rear side of the push button 11 rests flat on the broad side of the clamping-jaw carrier. The entire extension 19 here has penetrated into the depression 20 associated with it. In this position, as illustrated in FIG. 7, the web 32 of the U-shaped catch member 12 has passed out of its depression to the full extent and projects beyond the broad side of the clamping-jaw carrier. The free end 4' of the bolt 4 has passed out of the broad-side recess 26 associated with it and is located in the channel associated with it, outside the cross-sectional surface area of the through-opening 21, so that, in this position, the clamping-jaw carrier 10 can be drawn off from the rail.

If the clamping-jaw carrier is positioned on the rail again, then the push button is relieved of pressure loading in any desired push-in position. This results in the spring 9 pressing the free end 4' of the bolt 4 against the broad side of the rail 1. If the clamping-jaw carrier 10 is pushed over the rail in this state, then the free end 4' enters into the rail opening 3 if the opening 3 is aligned with the bolt 4.

In the case of the exemplary embodiment illustrated in FIGS. 10 to 13, both the web 32 and the push button 11, which is located opposite the web 32, are positioned in housing recesses 27, 31 in each case. The housing recess 31, which accommodates the spring 9 and which is associated with the push button 11, is of cup form. The cup wall is formed in a sleeve 29. In the locked position, as is illustrated in FIG. 11, the end border of the wall 29 is aligned with the surface of the push button 11. In this position, the surface of the web 32, which is located opposite the push button 11, is also aligned with the surface of a wall 30 which encloses the housing recess 27, which accommodates the web 32.

The push rod 17, which is connected to the rear side of the push button 11 in an eccentric position, is connected to the web 32, which carries the bolt 4, by means of a fastening screw 28. While the recess 31 has a circular cross-section, the recess 27 has an elongate cross-section. The fact that the push button 11 is accommodated in a cup-like recess 31 provides a safeguard against incorrect actuation. The push button has to be displaced into the cup-like recess 31 such that, in the displaced position, the wall 29 of the cup projects beyond the surface of the push button 11.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

What is claimed is:

1. A clamping tool, comprising:

a first clamping jaw releasably mounted on a rail by a bolt extending into an opening in the rail, the bolt being removable from the opening and insertable into another opening in the rail such that the first clamping jaw is mounted on the rail at another position;

a second clamping jaw mounted on the rail and displaceable by a clamping device into a clamping position in a direction toward the first clamping jaw and displaceable in a direction away from the first clamping jaw;

a spring having a force applied to the bolt such that the bolt is retained in an engagement position in the opening with the first clamping jaw; and a push button coupled to the bolt, the spring being subject to stressing when the bolt is displaced out of the opening by pressure applied to the push button.

2. The clamping tool according to claim 1, further comprising a U-shaped catch member having a shorter U-leg which forms the bolt end a longer U-leg which passes through the first clamping jaw outside of the rail and carries the push button.

3. The clamping tool according to claim 1, further comprising a jaw carrier which carries the clamping jaw and has a through-opening for the rail, wherein the bolt passes through the jaw carrier approximately in a center of the through-opening.

4. The clamping tool according to claim 3, wherein in a locking position, a free end of the bolt is located in an opening of an inner wall of the through-opening of the jaw carrier.

5. The clamping tool according to claim 2, wherein the longer U-leg is secured eccentrically to the push button.

6. The clamping tool according to claim 1, wherein the push button can be displaced counter to the force of the spring.

7. The clamping tool according to claim 1, further comprising a penetrating extension disposed on a rear side of the push button and, with the push button retained in a pushed-in position, penetrates into a recess of the first clamping jaw.

8. A clamping tool according to claim 2, wherein a U-web of the U-shaped catch member is located in a housing recess in a locking position and passes out of the housing recess during an unlocking operation.

9. The clamping tool according to claim 1, wherein the push button is positioned in a cup-like recess.

10. The clamping tool according to claim 9, wherein the cup-like recess is enclosed by a sleeve-like wall, and an end border of the sleeve-like wall is aligned with a surface of the push button.

11. The clamping tool according to claim 1, wherein a surface of the U-web which is located opposite the push button is aligned with an end border of a wall which encloses the housing recess.

* * * * *